US008732961B2

(12) United States Patent
Eichhorn et al.

(10) Patent No.: US 8,732,961 B2
(45) Date of Patent: May 27, 2014

(54) LOWER CUTTER FOR THE SHAVING HEAD OF A DRY SHAVER

(75) Inventors: Reinhold Eichhorn, Idstein (DE); Andreas Hartmann, Schwalbach (DE); Peter Junk, Schmitten (DE); Joachim Krauss, Pfungstadt (DE); Michael Odemer, Niddatal (DE); Andreas Peter, Kronberg (DE); Thorsten Pohl, Muehlheim (DE); Markus Sabisch, Waldems (DE); Tobias Schwarz, Schmitten (DE); Thomas Verstege, Frankfurt (DE); Juergen Wolf, Kriftel (DE); Christoph Zegula, Roedermark (DE)

(73) Assignee: Bruan GmbH, Kronberg (DE)

( * ) Notice: Subject to any disclaimer, the term of this patent is extended or adjusted under 35 U.S.C. 154(b) by 454 days.

(21) Appl. No.: 12/959,683

(22) Filed: Dec. 3, 2010

(65) Prior Publication Data

US 2011/0067244 A1 Mar. 24, 2011

Related U.S. Application Data

(63) Continuation of application No. PCT/EP2009/003600, filed on Mar. 20, 2009.

(30) Foreign Application Priority Data

Jun. 6, 2008 (DE) ..... 10 2008 027 224

(51) Int. Cl.
*B26B 19/04* (2006.01)

(52) U.S. Cl.
USPC ..... 30/346.51; 30/43.92

(58) Field of Classification Search
USPC ..... 30/43.8, 43.9, 43.91, 43.92, 346.51; D28/51
See application file for complete search history.

(56) References Cited

U.S. PATENT DOCUMENTS

| | | | | |
|---|---|---|---|---|
| 2,144,525 | A * | 1/1939 | Dalkowitz | 76/104.1 |
| 2,223,156 | A * | 11/1940 | Benner | 30/43.92 |
| 2,307,471 | A * | 1/1943 | Schaffer et al. | 30/43.92 |
| 2,325,606 | A | 8/1943 | Hanley | |
| 5,214,833 | A * | 6/1993 | Yada | 29/418 |
| 5,884,404 | A | 3/1999 | Ohle et al. | |
| 5,893,211 | A * | 4/1999 | Hotani | 30/43.92 |
| 6,615,492 | B2 * | 9/2003 | Parsonage et al. | 30/43.91 |
| 7,022,195 | B2 | 4/2006 | Otani et al. | |
| 7,313,867 | B2 * | 1/2008 | Okabe | 30/346.51 |
| 7,621,050 | B2 * | 11/2009 | Okabe et al. | 30/44 |
| 8,082,670 | B2 * | 12/2011 | Burghardt et al. | 30/346.51 |

(56) References Cited

| | | | |
|---|---|---|---|
| 2005/0155230 | A1 | 7/2005 | Okabe |
| 2006/0021234 | A1 | 2/2006 | Yanosaka et al. |
| 2011/0067244 | A1 | 3/2011 | Eichhorn et al. |

* cited by examiner

FOREIGN PATENT DOCUMENTS

DE 102005 009264 A1 8/2006

*Primary Examiner* — Hwei C Payer
(74) *Attorney, Agent, or Firm* — Jerry J Yetter; Jason J Camp

(57) ABSTRACT

The invention relates to a lower cutter (4) which, together with an associated upper cutter (6), forms the shaving head of a dry shaver. The upper cutter is designed in the form of a perforated foil (6) which at least partially encloses the lower cutter (4) and is prestressed against the same. The lower cutter (4) has a plurality of spaced-apart blades having cutting edges (12, 13) in the form of strips between two peripheral regions (9, 10). The lower cutter (4) is essentially U-shaped in cross section. The width of the strip tapers monotonously from the two peripheral regions (9, 10) in the direction of the center (Z).

1 Claim, 4 Drawing Sheets

LOWER CUTTER FOR THE SHAVING HEAD OF A DRY SHAVER

This application is a continuation of prior co-pending International Application No. PCT/EP2009/003600 filed Mar. 20, 2009, designating the United States.

The invention relates to a lower cutter which, together with an associated upper cutter, forms the shaving head of a dry shaver according to the preamble of Claim 1.

A lower cutter of this type is already known from U.S. Pat No. 7,022,195 B2, wherein this lower cutter is composed of a plurality of strip-shaped blade elements which have a constant width or a width that increases toward the center.

Such cutters are located inside the shaving head of a dry shaver, driven in an oscillatory fashion and pressed against the perforated foil, and are subject to complex loads during the shaving process.

For example, they are acted upon by the contact pressure with which the user presses the shaver against the skin, causing the strip-shaped blades to be subjected to a bending load around an axis that corresponds to the width of the blades. During the shearing of a hair, an additional mechanical load arises due to the cutting forces, which is a bending load at the zenith and becomes a complex load consisting of biaxial bending and torsion in an outwardly direction. An additional load is created by the friction between the perforated foil and the lower cutter itself.

Lower cutter designs according to the known type have the disadvantage that they generate very high friction losses due to viscous friction between the perforated foil and the associated friction surfaces of the lower cutter. This results in high energy consumption and, for the user, uncomfortable heating of the shaving parts as well as premature wear. Because of the uneven mechanical stress distribution over the length of the individual blades, these bulge unevenly over the entire length of the blade due to the forces that occur when the shaving head is pressed against the skin of the user. This leads to a partial loss of direct contact between lower cutter and perforated foil, as a result of which hairs that are already threaded into the perforated foil are not cut, but merely drawn in, which may lead to the hair being painfully pulled from the skin. Moreover, the uneven bulging of the blades may damage the perforated foil. It is therefore the object of the invention to improve a lower cutter of the mentioned type in a cost-effective way with regard to its performance and stability. This object is achieved according to the invention by the characterizing features of Claim 1.

The solution according to the invention achieves that the material load is uniformly distributed over the entire length of the individual blades, thereby assuring a permanent, uniform contact between the perforated foil and the lower cutter, even under heavy loads. This also makes it possible to keep the blades narrow in the actual cutting region without loss of stability, which makes it possible to reduce the viscous friction between perforated foil and lower cutter. This also allows for better utilization of the material used.

According to a preferred embodiment, the invention provides that the taper of the width of the blade strips is stepless, which promotes an even load distribution along the blade. In particular, the taper of the strip width is designed in an arcuate fashion.

If the taper of the strip width of the blades is implemented in the form of at least two transition radii, the risk of blades breaking in the transition region between the peripheral regions and the blade itself can be diminished. By appropriately designing the transition radii, the effect of the notch in this transition region can be virtually eliminated.

The blades are preferably designed to be symmetrical with respect to the midline of the strip and preferably have acute-angled cutting edges to reduce the cutting forces occurring during shaving.

Further objectives, features, advantages, and possible applications of the present invention will become apparent from the following description of an exemplary embodiment. The subject matter of the present invention embodies all of the described or depicted features, individually or in any combination, and irrespective of their summary in the claims or their dependencies.

The following is shown:

Figure 1:
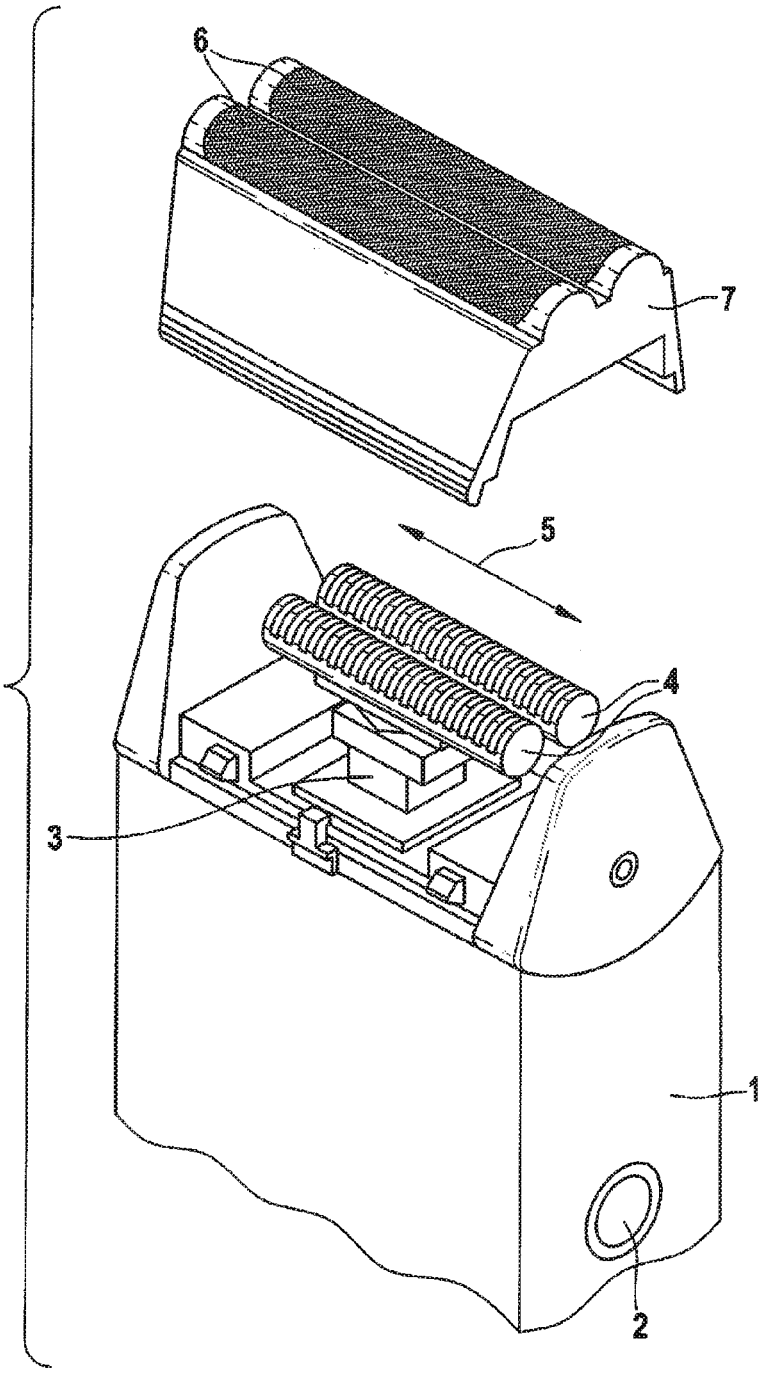
FIG. 1 shows the basic design of the cutter assembly of a dry shaver.

The dry shaver shown in FIG. 1 comprises a casing 1 which, among other things, serves to house an electric motor (not shown in the drawings) and optionally rechargeable batteries for storing energy (also not shown in the drawings), and is provided with an on/off switch 2. On the top face of the dry shaver, a drive element 3 driven for oscillation is led out from the casing 1. The lower cutters 4 engage with the drive element 3 via appropriate/suitable connecting means known per se. This enables the two lower cutters 4 that are arranged parallel to one another to be driven in an oscillating fashion along their longitudinal extension, as per the double arrow 5.

The lower cutters 4 are at least partially enclosed by the two upper cutters, each of which is designed as a perforated foil 6. They are mounted in an interchangeable frame 7, which can be snapped together with the casing 1. The perforated foils 6 are perforated over their entire surface with passthrough-openings, which may be designed as holes and/or slits and through which the hairs that are to be shaved enter into the shaving head during the shaving process. Because of the cutting edges, which are designed both on the passthrough-openings of the foil and on the lower cutters 4, and because of the movement of the lower cutters 4 relative to the perforated foils 6, the hairs that have entered into the shaving head are sheared off between the associated shearing edges.

Figure 2:
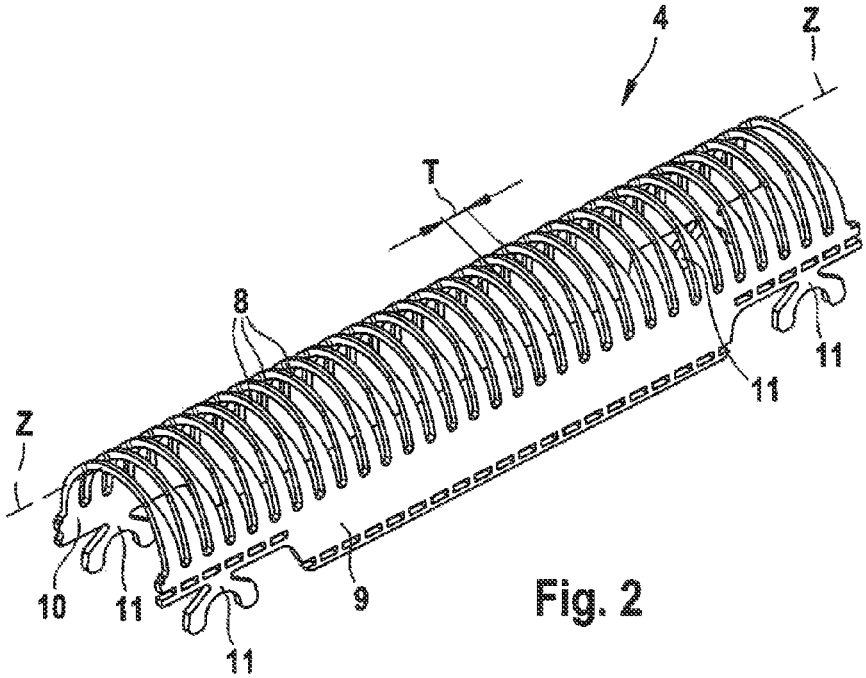
FIG. 2 shows the perspective view of a lower cutter according to the invention.

The lower cutter 4 according to the invention shown in FIG. 2 has a multiplicity of U-shaped blades 8 extending parallel to one another which extend in the form of strips between the two peripheral regions 10 and 9. Each of the two peripheral regions 9 and 10 has a mounting section 11 at its front and back end to connect to a support member, details of which are not shown in the drawings, which, ultimately, serves to connect the lower cutter 4 to the drive element 3 of the dry shaver. The longitudinal extension of each peripheral region 9 and 10 between its two mounting sections 11 corresponds to the direction of oscillation as per the double arrow 5. The blades 8 extend perpendicular to the longitudinal extension of the peripheral regions 9, 10 according to the exemplary embodiment shown here. The width of the blades 8 and the separation T of the blades of the lower cutter 4 are measured parallel to the longitudinal extension of the peripheral regions. As is already visible in FIG. 2 and shown in more detail in FIG. 3, the width of the strip-shaped blades 8 is not constant along their length L1, but rather tapers from the peripheral section 9 towards the zenith of the arc and widens again from there towards the peripheral region 10. This is especially apparent from the illustration according to FIG. 3.

Figure 3:
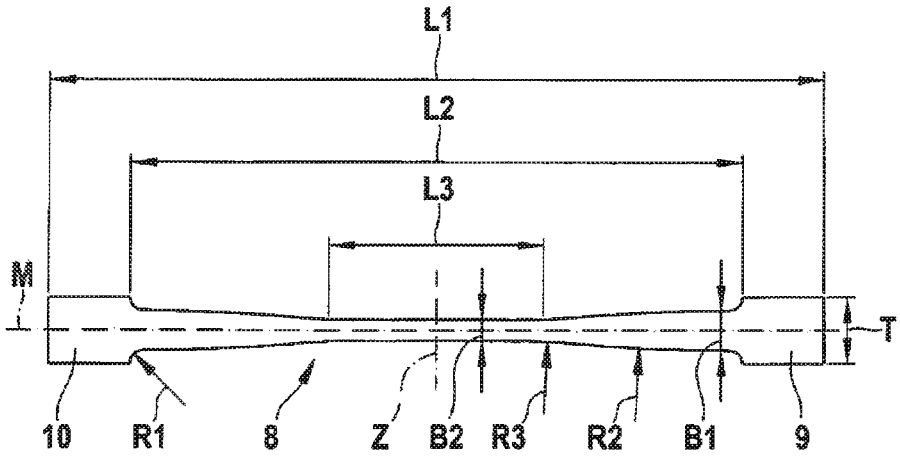
FIG. 3 shows the developed view of an individual blade of the lower cutter according to the invention.

FIG. 3 shows the developed view of an individual blade 8, which is designed symmetrically, both with regard to the midline M and with regard to the zenith Z. The peripheral regions 9, 10 are shown in FIG. 3 with the width of the separation T, which is approximately 1 mm.

The total length L1 of the blade 8 is approximately 11.5 mm. The total tapered region of the blade 8, which is bounded on both sides by the extension piece of the inner radii R1 at the end regions 9, 10, extends over a length L2 of approximately 8.9 mm.

Starting from the peripheral regions 9, 10, the blade 8 tapers by means of a concave inner radius R1, which measures approximately 0.2 mm, to the width B1, which measures approximately 0.58 mm. Adjoining same is a concave outer radius R2 of approximately 33 mm. In this way, the blade achieves a convex outer contour in this region along its longitudinal extension. At the inside end of the radius R2, the blade transitions to the parallel middle section by means of a concave inner radius R3 of approximately 3.5 mm. This section has a width B2 of 0.32 mm and a length L3 of approximately 3.1 mm.

The taper of the blade width by means of the radius R1 eliminates the notch effect, which could lead to blades breaking in the connecting region between the peripheral regions 9, 10 and the blades 8 themselves, and which is caused by the bending load occurring due to the cutting forces. The outer radius R2 distributes stress equally in the region of the greatest bending and torsional load, preventing stress peaks. The inner radius R3 eliminates the notch effect between R2 and the parallel middle section L3.

The cross-sectional reduction of the blades 8, from the peripheral regions 9, 10 to the zenith axis Z, extends approximately according to the decrease in the bending and torsional movements that result from the cutting forces and the frictional forces, yielding a very homogeneously distributed stress load overall along the length of the blade (or, in the U-shaped bent final state, along the height of the blade). This favors optimum material utilization and prevents irregular deformations.

Figure 4:
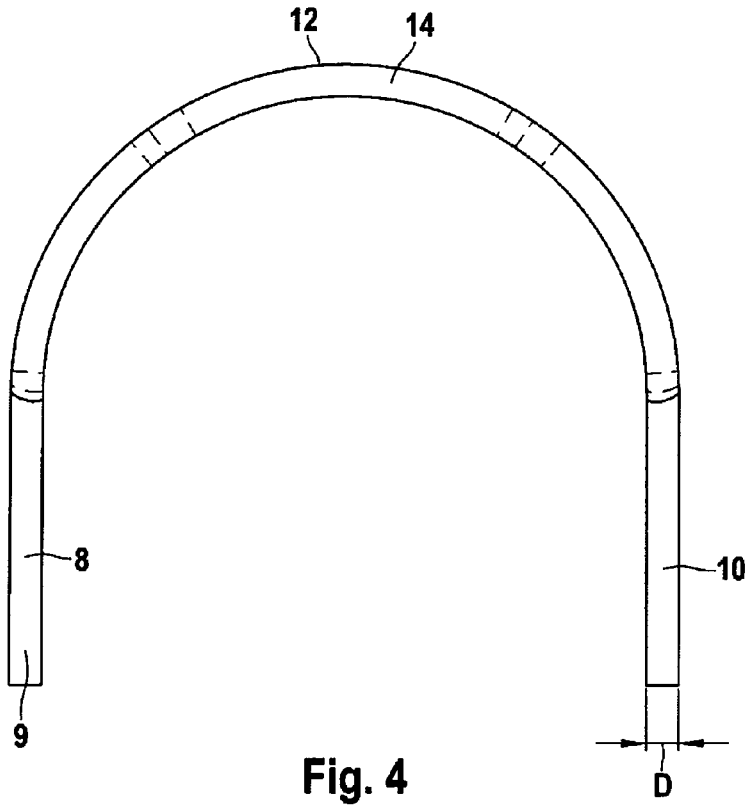
FIG. 4 shows the front view of an individual blade element.
Figure 5:
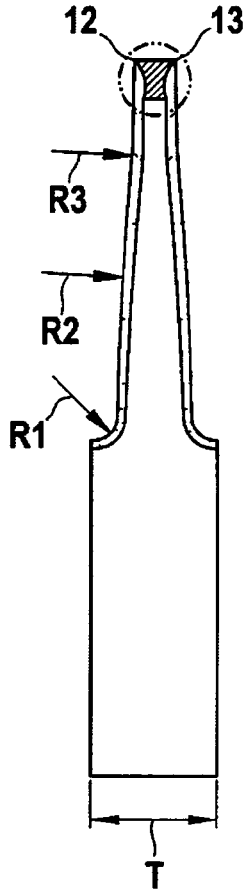
FIG. 5 shows a section through such a blade element.

FIG. 4 shows a view of a bent blade element 8, which was produced by bending an originally flat lower cutter 4 into an appropriate U-shape. In turn, the original flat lower cutter 4 is in particular produced by an etching method from a strip-shaped metal starting shape, into which the slits between the individual blades 8 are etched. This starting shape is then bent to form a U-shape, resulting in a lower cutter as shown in FIG. 2. As a result of the production by means of etching, an undercut is created in the region of the two opposed cutting edges 12, 13 of each blade 8, as clearly shown in FIGS. 5 and 6. After the bending into the U-shape, this undercut 14 is on the inside of the arc. As can be seen in FIG. 4, the material thickness of the metal starting sheet D is approximately 0.3 mm.

Figure 6:
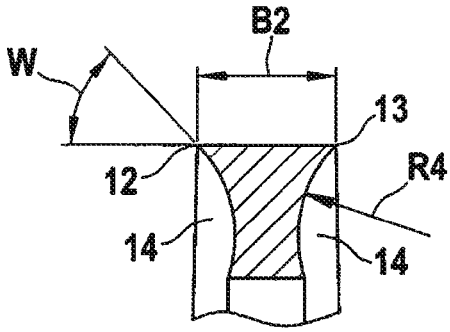
FIG. 6 shows an enlarged detail view of FIG. 5.

The undercut below each of the two cutting edges 12, 13, clearly shown in FIG. 6, extends along a radius R4 of approximately 0.3 mm and creates a cutting edge angle W of approximately 50° at the cutting edges 12, 13.

What is claimed is:

1. A lower cutter (4) which, together with an associated upper cutter (6), forms the shaving head of a dry shaver, wherein the upper cutter is designed in the form of a perforated foil (6) which at least partially encloses the lower cutter (4) and is pre-stressed against the same, and wherein the lower cutter (4) has a plurality of spaced-apart blades (8) having cutting edges (12, 13), said blades being in the form of strips between two peripheral regions (9, 10), said cutting edges having acute cutting edge angles (W), and said blades being essentially U-shaped in cross section, characterized in that the width of each blade tapers from the two peripheral regions (9, 10) in the direction of the center (Z) of the blade at its zenith, said tapering being by means of a concave inner radius R1, which measures about 0.2 mm, to a width B1, which measures about 0.58 mm, adjoning which is a concave outer radius R2 of about 33 mm, whereby the blade achieves a convex outer contour along its longitudinal extention; at the inside end of the radius R2, the blade transitions to a parallel middle section by means of a concave inner radius R3 of about 3.5 mm, said parallel middle section having a width B2 of 0.32 mm and a length L3 of about 3.1 mm.

* * * * *